US007037246B2

(12) United States Patent
Kim

(10) Patent No.: US 7,037,246 B2
(45) Date of Patent: May 2, 2006

(54) SPRING PACK

(75) Inventor: Yong Woo Kim, Rochester, NY (US)

(73) Assignee: Kellion Corporation, Rochester, NY (US)

( * ) Notice: Subject to any disclaimer, the term of this patent is extended or adjusted under 35 U.S.C. 154(b) by 299 days.

(21) Appl. No.: 10/662,214

(22) Filed: Sep. 12, 2003

(65) Prior Publication Data

US 2005/0059534 A1 Mar. 17, 2005

(51) Int. Cl.
*A63B 21/04* (2006.01)

(52) U.S. Cl. ..... 482/129; 482/121

(58) Field of Classification Search ..... 482/92, 482/112, 113, 121, 122, 127, 129, 130
See application file for complete search history.

(56) References Cited

U.S. PATENT DOCUMENTS 4,600,196 A * 7/1986 Jones ..... 482/137
4,666,149 A * 5/1987 Olschansky et al. ..... 482/130
4,733,860 A * 3/1988 Steffee ..... 482/136
5,039,092 A * 8/1991 Olschansky et al. ..... 482/130
5,074,551 A * 12/1991 Olschansky et al. ..... 482/137
5,348,524 A * 9/1994 Grant ..... 482/130
5,522,784 A * 6/1996 Grant ..... 482/130
5,637,062 A * 6/1997 Schmittner ..... 482/97
6,561,956 B1 * 5/2003 Allison ..... 482/94
6,793,610 B1 * 9/2004 Deola ..... 482/130
2005/0049121 A1 * 3/2005 Dalebout et al. ..... 482/93
2005/0059535 A1 * 3/2005 Kim ..... 482/121

* cited by examiner

*Primary Examiner*—Stephen K. Cronin
*Assistant Examiner*—Victor K. Hwang
(74) *Attorney, Agent, or Firm*—Brown & Michaels, PC

(57) ABSTRACT

A variable spring resistance to movement of a rod uses a plurality of springs permanently connected between a base and a stack of end connector links extending in the direction of the rod movement. Selecting which of the links is connected to the rod then determines which of the springs are deployed to resist movement of the rod, without requiring any disconnection or reconnection of the springs. The selection can be made by a pin inserted through an aligned hole between a link and the rod.

24 Claims, 3 Drawing Sheets

SPRING PACK

TECHNICAL FIELD

Variable spring resistance devices

BACKGROUND

Exercising devices often provide spring resistances for humans to work against while building and training muscles. Although different numbers of springs or other elastically deformable elements can be used to provide the variable resistance, springs and bungie cords, for example, have to be hooked up and unhooked to change the amount of resistance desired. Springs not in use have to be parked out of the way, and the hooking and unhooking of tension springs is time consuming and inconvenient. The connecting and disconnecting of springs can also result in springs snapping lose from a person's grip, and can cause minor injuries such as bruised or pinched fingers.

SUMMARY

This invention solves the problem of connecting and disconnecting springs, bungie cords, and similar elastically extendable elements by providing a grouping of these elements, all in a connected condition, arranged so that a desired number of elements to be deployed for a resistance can be easily selected. The invention thus aims at packaging a collection of springs or resistance elements that need not be connected or unconnected during use, but also can be selected in different numbers to provide a desired resistance. The selectable combination of spring resistances offered by the invention thereby improves speed and convenience and eliminates the annoyance of having to connect and disconnect springs to adjust an exercising resistance.

The preferred way of accomplishing these goals is to use a rod whose movement is resisted by a selectable array of springs that remain connected to links or end connectors during the selection process, which involves selectively attaching the links or end connectors to the rod. Without disconnecting or reconnecting any spring ends, different numbers of the plurality of springs can be deployed to resist movement of the rod by means of varying the attachment of moveable links or end connectors to the rod. This can be done by arranging the end connectors in a stack and using an attachment device such as a pin and hole arrangement to select from the stack the end connector that will move with the rod and thereby determine the number of springs that will be deployed to resist movement of the rod.

DRAWINGS

DETAILED DESCRIPTION

The illustrated embodiment of the invention was devised to facilitate selection of springs deployed to resist movement for exercising purposes. The inventive spring arrangement that is workable for variable exercising resistance can also be used for other purposes such as variable counter-balancing and variable spring energy storage. These other uses may need adaptations that depart in obvious ways from the preferred embodiment described in this application.

Figure 1:
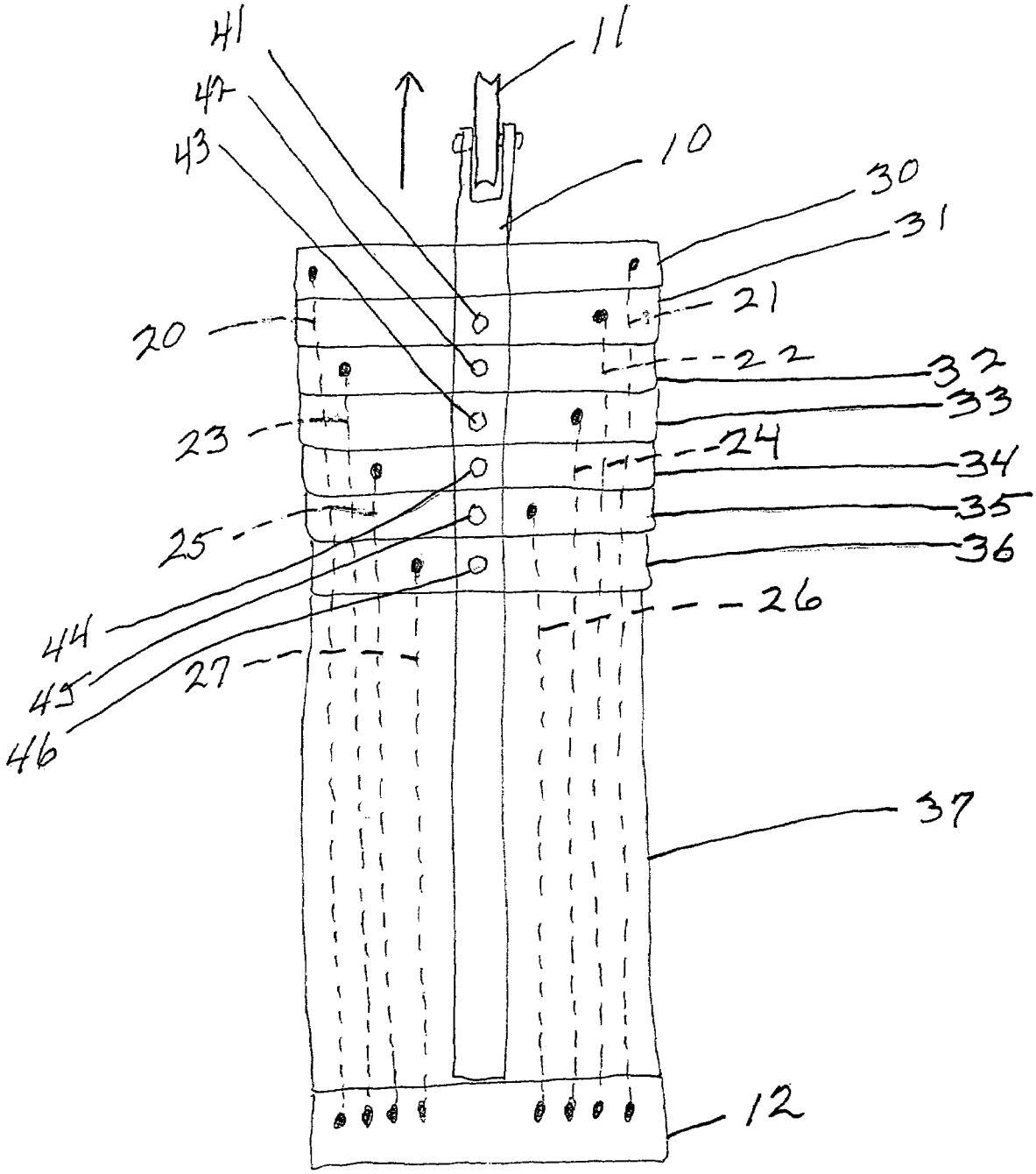
FIG. 1 is a partially schematic front elevational view of a preferred embodiment of spring pack according to the invention.

The movement to be variably resisted is performed by a rod 10, which moves in an extending or resisted direction away from base 12 as shown by the arrow in FIG. 1. The extending or operational direction of movement of rod 10 is then resisted by different numbers of springs for exercising or other purposes. A pulley 11 mounted on rod 10 facilitates this by offering a connection to a cord or cable that may be part of a block and tackle system (not shown) to direct or proportion a movement resisted by rod 10.

A preferred material for forming rod 10 is a rectangular cross-sectioned tube or box beam, but many other forms are also possible. These include a cylindrical tube, a shaft, a tube or shaft having 5 or more sides, a channel or angle, an i-beam, t-beam or h-beam or an assembly of such elements that can be made of metal or plastic, and possibly formed as an extrusion. The characteristics that are desirable for rod 10 are longitudinal uniformity and sufficient strength to endure the required spring resistance.

The springs 20–27, shown as broken lines in the drawings, are preferably coiled extension springs formed with hooks on each end, which are widely and inexpensively available. Other elastic elements capable of resisting movement in an extending direction can be substituted, though; these include bungie cords, elastic tubing, wound coil springs and pneumatic cylinders. To simplify the drawings, the end connections of springs 20–27 are illustrated as dots in FIGS. 1–3.

All of the springs have fixed ends that are preferably connected to base 12, which remains motionless. Moving ends of the springs are then connected to links or end connectors 30–36. These are preferably arranged in a stack around rod 10 so that rod 10 can move back and forth relative to base 12 and relative to any of the links that remain motionless. A preferably open channel 37 serves as a spacer and housing enclosure between base 12 and the nearest spring end connector link 36.

Springs 20–27 are preferably somewhat extended and therefore under light tension when connected to links 30–36 in the home position shown in FIG. 1. Springs 20–27 then hold links 30–36 under slight compression in the illustrated stacked arrangement. For this purpose, links 30–36 preferably engage each other around their respective peripheries to remain snugly stacked during operation. To accommodate this arrangement, springs 20–27 can have different lengths and different spring resistances.

For exercise purposes it is undesirable for rod 10 to be free to move without any spring resistance, and to achieve this link 30, which is farthest from base 12, is preferably permanently connected to rod 10 so that link 30 always moves with rod 10. In the illustrated embodiment, springs 20 and 21 are connected to link 30 so that these two springs always resist movement of rod 10. It is also possible to devote only a single spring to permanent resistance of movement of rod 10, or to make link 30 selectively connectable to rod 10 so that rod 10 is free to move without any spring resistance.

Rod 10 preferably has a series of holes 41–46 that align with corresponding holes 41–46 in links 31–36. Since holes 41–46 in both links and rod are aligned in the home position illustrated in FIG. 1, a single circle represents each of the aligned holes.

To select which of the springs 22–27 will additionally resist movement of rod 10, it is merely necessary to connect one of the links 31–36 with rod 10. This can be conveniently done with a pin 40 insertable through one pair of the aligned holes 41–46 to pin the selected link to rod 10.

Figure 2:
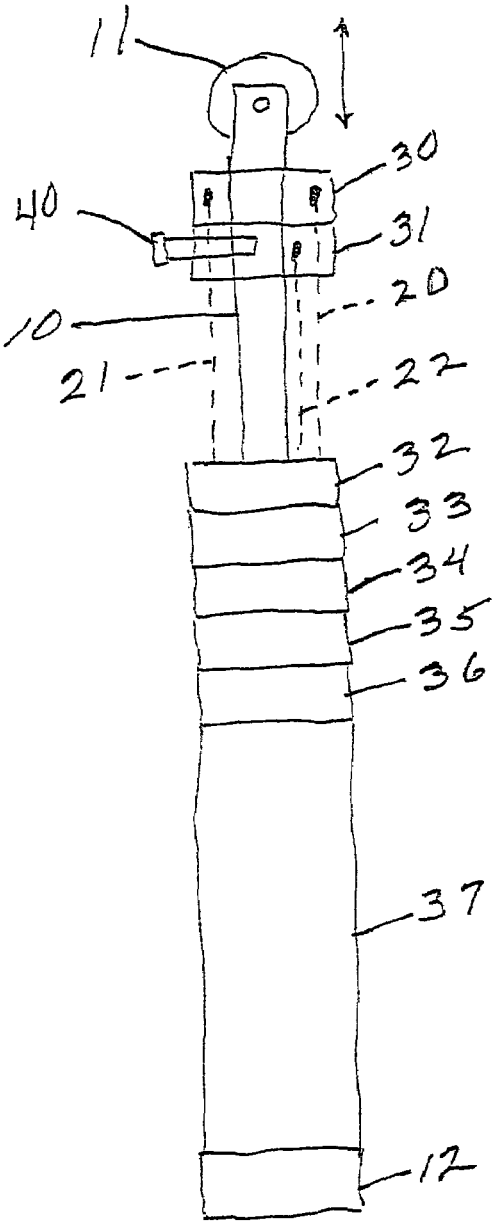
FIGS. 2 and 3 are partially schematic side elevational views of the spring pack of FIG. 1 showing selection of different numbers of springs to resist exercising movement.
Figure 3:
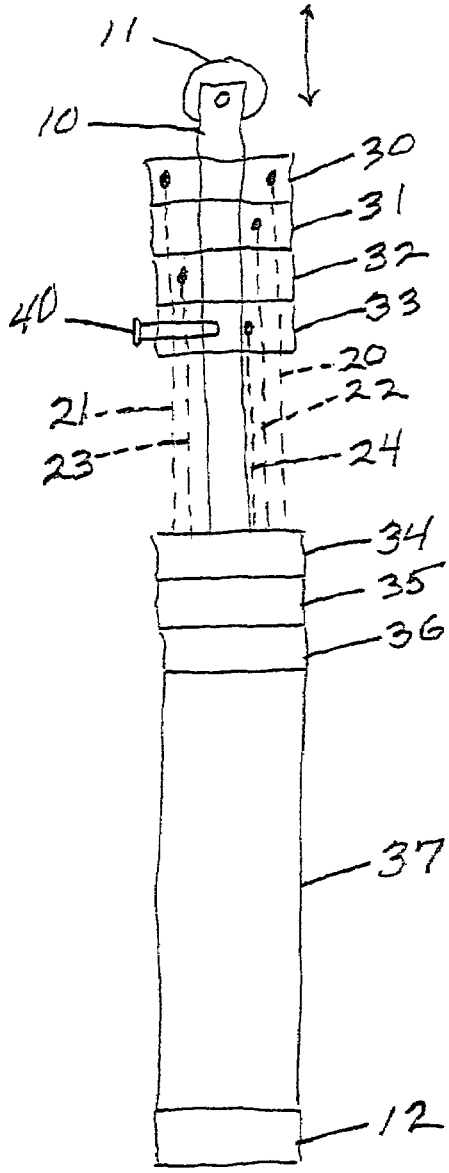

The selecting and pinning of different links to rod 10 is best shown in FIGS. 2 and 3. In FIG. 2, link 31 is connected to rod 10 by pin 40 so that links 30 and 31 move with rod 10. This adds spring 22 to the basic movement resistance otherwise applied by springs 20 and 21. When pin 40 connects link 33 to rod 10, as shown in FIG. 3, links 30–33 move with rod 10 while supplying resistance by springs 20–24. FIGS. 2 and 3 thus illustrate that any link on an exercising or resisted direction side of a link pinned to rod 10 will move with rod 10, and any link left on a base side of a pinned link remains with base 12 and channel 37 while rod 10 moves. Moving pin 40 into different aligned holes 41–46 when the spring pack is in the home position shown in FIG. 1, thereby determines which of the links is pinned to rod 10 and also establishes which of the links will deploy spring resistances to rod movement, and which of the links, if any, will remain on the base side of the pinned link and will not deploy spring resistance to rod movement. The illustrated arrangement can thus resist rod movement by different numbers of springs ranging from 2 to 8, simply by selecting which of the aligned holes 41–46 will be used for connecting insertion of pin 40.

Figure 9:
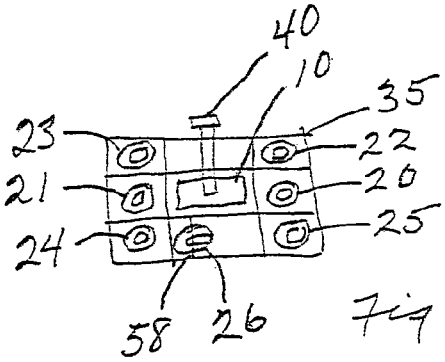
Figure 10:
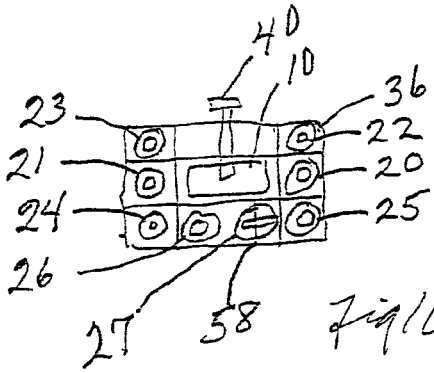
Figure 11:
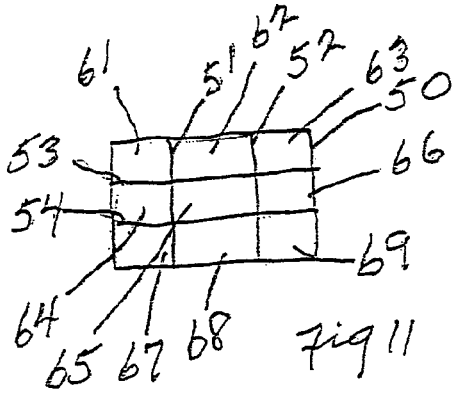
FIG. 11 is a partially schematic view of a preferred form of extrusion that is adaptable to form the links of FIGS. 4–10.

Each of the links 30–36 can conveniently be formed as an extrusion shaped as a box beam 50 as shown in FIG. 11, with intersecting interior cross-webs 51–52, in a tic-tac-toe pattern, dividing the interior of beam 50 into nine compartments 61–69. Such an arrangement can create passageways through the compartments for a spring to extend through one link to a connection with another link spaced farther from base 12. Also, using the same basic extrusion pattern shown in FIG. 11, it is possible to form three adaptations of the basic extrusion 50 supplying spring connecting webs across different ones of the compartments, as shown in FIGS. 4–10.

Figure 4:
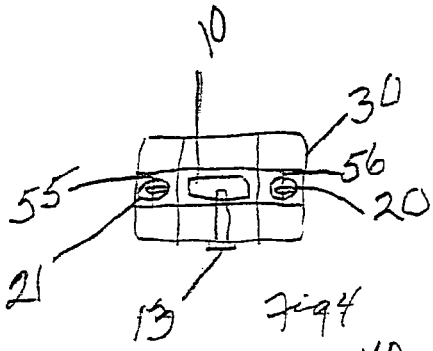
FIGS. 4–10 are partially schematic views of different links or end connectors in a stack arranged to require a different number of springs to move with a rod.

The preferred permanent connection of link 30 to rod 10 can be done with some sort of fastener that is schematically illustrated as a screw or pin 13 in FIG. 4. Many other fasteners, adhesives, or weldments are possible to accomplish this connection. A pair of spring connecting webs 55 and 56 are formed to extend across a pair of compartments, such as compartments 64 and 66. Compartmental cross-webs 55 and 56 afford connections for hooks on the ends of springs 20 and 21, which are thereby deployed to resist any movement of rod 10 in an operative or extending direction.

Figure 5:
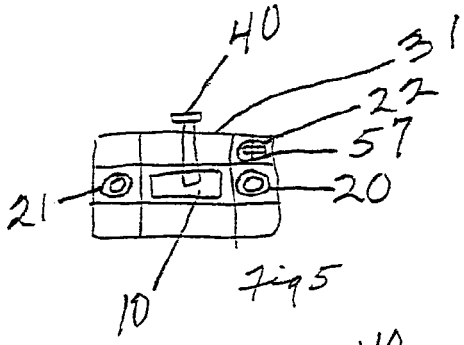
Figure 6:
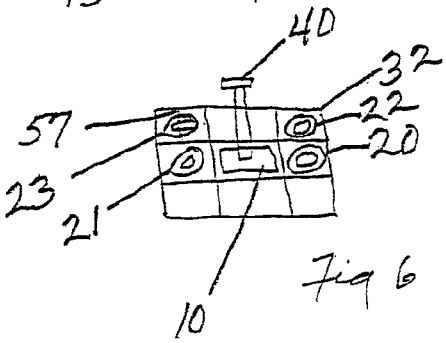
Figure 7:
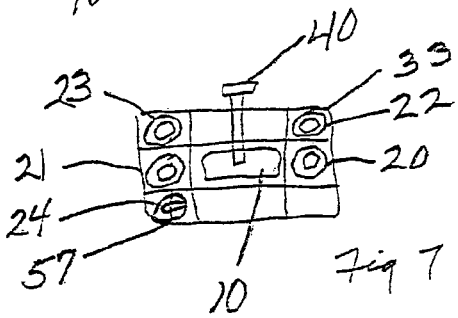
Figure 8:
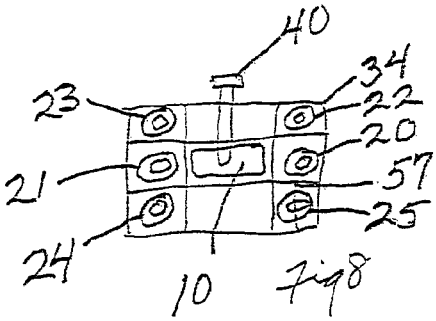

Another extrusion, used for links 31–38, provides a spring connecting link in a corner compartment, such as compartment 63 as illustrated in FIG. 11. Since each link 31–34 is formed of a short cutoff length of an extrusion having spring connector 57 in a corner position, such links can be flipped over right-to-left or top-to-bottom so as to dispose spring connecting web 57 in any corner of the link stack. Thus, link 31 disposes spring connector 57 in an upper right hand corner as shown in FIG. 5. This allows springs 20 and 21 to pass through link 31 while spring 22 attaches to connector 57 in the compartment 63 position. Another link 32 in a right-to-left flip over position shown in FIG. 6 disposes spring connector 57 in the upper left or 61 position compartment where it affords a connection to spring 23 while allowing springs 20–22 to pass through. The same extrusion reoriented in a top-to-bottom flip, as shown for link 33 in FIG. 7, disposes spring connector 57 in a lower left corner in the compartment 67 position. Here, spring 24 attaches to connector 57, while link 33 affords through passageways for springs 20–23. Finally, link 34, in another flipped over position, disposes spring connector 57 in a lower right corner compartment position 69 to connect to spring 25 while leaving through passageways for springs 20–24. Successive springs in the link stack are preferably arranged on opposite sides of rod 10 to keep spring forces approximately balanced.

The arrangement of FIGS. 4–8 provides variable spring resistance arranging from two to six springs, and achieves this with two spring connector variations of a basic extrusion pattern. FIGS. 9 and 10 show how two more springs can be added by using another spring connector position 58 connecting to springs 26 and 27. If sufficient room is provided in compartments 62 and 68, spring connector 58 can be oriented in different positions to add two more springs to each of these compartments. Such added springs should avoid interference with placement of connecting pin 40, and as such added springs are desired, it would be preferable to divide each of the compartments 62 and 68 into separate spring compartments to eliminate any interference or noise between adjacent springs.

Compartmented extrusions can also be arranged in many other configurations that can house a desired number of springs to be selectively deployed to resist the movement. One possibility is a radially variable or rotatable link that can dispose spring passages and spring connectors in different positions around a preferably multisided rod. The decisions can be based on the number of springs desired, the space available, and the attractiveness and economy of the end result. Another consideration is to leave one of the compartments free of springs so as to accommodate placement of pin 40. The number of links and springs can be increased to meet any conceivable need.

Springs can have end connections made without using hooks formed at the ends of springs, and connectors are known that interlock between spring coils near a spring end. Hooks formed on end coils of springs are inexpensive and commonplace, though, and can readily be connected to links 30–36, simply by hooking over spring connector webs 56–58 as a spring pack is assembled. Once this is done, the springs need not be disconnected or reconnected again, because their selection can be achieved simply through placement of pin 40.

Instead of a single pin 40 disposable in a selected one of the aligned holes 41–46, a connecting pin can be pivotally mounted on each link and can be pushed into an operative position or pulled to an inoperative position. A sliding bar, hook, or other element can be substituted for pin 40, and a pin can be inserted into rod 10 in a space made available between links.

I claim:

1. A variable resistance exercising device using a rod moveable in an exercising direction and a plurality of extension springs selectively deployable to resist movement of the rod in the exercising direction, the device comprising:

a) a plurality of links interconnectable with the springs and arranged around the rod;

b) a dedicated one of the links being connected to the rod to move with the rod;

c) a remainder of the links being arranged in a stack extending from the connected.link toward a base in a direction opposite to the exercising motion;

d) each of the springs having a fixed end connected to the base and a moveable end operatively connected to one of the links;

e) the remaining links being formed to allow springs to pass through a link nearer to the base to reach a link arranged farther from the base;

f) each of the remaining links having a hole, and the rod having a series of holes registering with the link holes when the rod is in a home position;

g) a pin insertable through any one of the link holes into a corresponding rod hole to pin any one of the remaining links to the rod; and h) any link disposed in the exercising direction from a pinned link being moved with the rod when the rod moves in the exercising direction, and any link disposed on a base side of a pinned link remaining in place when the rod moves in the exercising direction so that selecting the link to be pinned to the rod also selects the number of extension springs that are deployed to resist movement of the rod in the exercising direction without requiring any change in spring end connections.

2. The exercising device of claim 1 wherein each of the remaining links has a spring connection that can be oriented in a different position relative to the rod when the remaining links are assembled in the stack so that a single form of link can supply several different spring connection positions.

3. The exercising device of claim 2 wherein each of the remaining links are formed as an extrusion.

4. The exercising device of claim 1 wherein the springs connected to the remaining links are extended to bias the remaining 10 links toward the base while the remaining links remain in the stack.

5. A method of selecting different numbers of extension springs to resist movement of a rod as it moves in an extending direction, the method comprising:

a) operatively connecting each of the extension springs between a base and one of a plurality of selectable links arranged around the rod;

b) attaching a selected one of the selectable links to the rod while leaving all but the selected one of the selectable links unattached to the rod; and c) moving the rod to extend with the rod any spring connected to the selected link and to any link on an extending direction side of the selected link, and not to extend with the rod any spring attached to any link on a base side of the selected link.

6. The method of claim 5 including inserting a pin through a hole in the selected link and into a registered hole in the rod to attach the selected link to the rod.

7. The method of claim 5 including positioning the rod at a home position closest to the base when attaching the selected link to the rod.

8. The method of claim 5 including fixing to the rod a dedicated and unselectable link positioned farthest from the base.

9. The method of claim 5 including arranging springs to pass through links nearer to the base to reach links farther from the base.

10. The method of claim 5 including arranging the selectable links in a link stack surrounding the rod and extending away from the base in the extending direction.

11. A spring deployment selector using a rod moveable in an exercising direction and a plurality of springs extendable in the exercising direction to resist movement of the rod, the selector comprising:

a) each of the springs being connected between a fixed object and one of a plurality of selectable links arranged in a stack around the rod;

b) any one of the selectable links being attachable to the rod when the rod is in a home position;

c) attachment of a selected one of the selectable links to the rod determining which of the selectable links in the stack move with the rod in the exercising direction and which of the selectable links in the stack do not move with the rod in the exercising direction; and d) the selectable links are configured to allow springs to pass through links nearer to the fixed object to reach links farther from the fixed object.

12. The selector of claim 11 wherein movement of the rod is guided through the stack.

13. The selector of claim 11 wherein the selectable links have holes, the rod has a series of holes that in a home position align with the link holes, and a pin is insertable through a hole in the selected link and into the rod to attach the selected link to the rod.

14. The selector of claim 11 wherein each of the selectable links has a spring connection that can be oriented in different positions as the links are arranged in the stack.

15. A combination comprising:

a plurality of spring links combined with a plurality of springs and a rod moveable in a resisted direction;

each of the links having a hole and the rod having a corresponding plurality of holes registered with the link holes in a home position of the rod and the links;

a pin insertable through a single link hole and into a rod hole to attach a selected one of the links to the rod; and the springs being operatively connected between the links and a fixed object so that connecting the selected one of the links to the rod determines which of the links move with the rod in the resisted direction and thereby establishes which of the springs resist movement of the; and the links are formed as extrusions that can be arranged in different orientations around the rod.

16. The combination of claim 15 wherein the links are arranged in a stack around the rod.

17. The combination of claim 15 wherein the links are configured to allow a spring to pass through a link to reach another link.

18. A variable spring resistance assembly using a plurality of springs and comprising:

a) each of the springs having fixed ends connected to a fixed retainer and having moveable ends connected to a series of stacked and moveable links;

b) a rod extending through the moveable links and being moveable in a resisted direction; and c) a plurality of the links being selectively connectable to the rod so that connecting a single selected one of the links to the rod determines the portion of the link stack that moves with the rod in the resisted direction and thereby determines that the springs connected to the moving portion of the link stack will resist movement of the rod in the resisted direction.

19. The resistance assembly of claim 18 wherein the springs are extended between the fixed retainer and the link connections and thereby bias the link stack in a home position.

20. The resistance assembly of claim 18 wherein holes extend through links in the stack and register with holes in the rod in a home position of the rod and the stack, and a pin insertable through a hole of the single selected link and into a rod hole attaches the selected link to the rod.

21. A spring resistance assembly deploying different numbers of springs to resist movement of a rod, the spring assembly comprising:

a) at least one of a plurality of springs being connected to the rod to provide basic resistance to movement of the rod;

b) the remaining plurality of springs being connected to a plurality of moveable end connectors that are selectively attachable to the rod so that without disconnecting or reconnecting any spring ends, different numbers of the remaining plurality of springs can be deployed to resist movement of the rod by means of varying the attachment of moveable end connectors to the; and c) the end connectors are configured to allow springs to pass through one end connector to reach another end connector.

22. The spring resistance assembly of claim 21 wherein the moveable end connectors are arranged in a stack around the rod so that attaching one of the end connectors to the rod determines what proportion of the stack will move with the rod and be resisted by springs connected to the moveable portion of the stack.

23. The spring resistance assembly of claim 21 including a pin and hole arrangement for selectively attaching one of the end connectors to the rod.

24. The spring resistance assembly of claim 21 wherein the at least one spring is connected to an end connector that is fixed to the rod.

* * * * *